US006347830B1

(12) United States Patent
Chen

(10) Patent No.: US 6,347,830 B1
(45) Date of Patent: Feb. 19, 2002

(54) HIGH CHAIR HAVING LOCKABLE PIVOTAL COUPLER DEVICE

(75) Inventor: Jueh-Cheng Chen, Tainan (TW)

(73) Assignee: Trident Company Ltd., Tainan (TW)

( * ) Notice: Subject to any disclaimer, the term of this patent is extended or adjusted under 35 U.S.C. 154(b) by 50 days.

(21) Appl. No.: 09/598,659

(22) Filed: Jun. 21, 2000

(51) Int. Cl.[7] ..... A47C 4/00; E05D 11/10

(52) U.S. Cl. ..... 297/16.1; 297/344.14; 16/333

(58) Field of Search ..... 297/16.1, 344.14; 16/324, 325, 326, 327, 328, 329, 333, 334, 335

(56) References Cited

U.S. PATENT DOCUMENTS

| | | | | | |
|---|---|---|---|---|---|
| 4,087,885 | A | * | 5/1978 | Gillentine | 297/367 X |
| 4,540,306 | A | * | 9/1985 | Wang | 16/332 X |
| 4,577,986 | A | * | 3/1986 | Wang | 16/332 X |
| 4,602,889 | A | * | 7/1986 | Mu-Shan | 16/326 X |
| 4,603,902 | A | * | 8/1986 | Maloney | 297/35 |
| 5,022,118 | A | * | 6/1991 | Wan-Li | 16/327 |
| 5,142,739 | A | * | 9/1992 | Lin | 16/326 |
| 5,238,292 | A | * | 8/1993 | Golenz et al. | 297/153 |
| 5,364,137 | A | * | 11/1994 | Shimer | 297/327 X |
| 5,507,550 | A | * | 4/1996 | Maloney | 297/344.14 X |
| 5,707,104 | A | * | 1/1998 | Perego | 297/16.1 |
| 5,951,102 | A | * | 9/1999 | Poulson et al. | 297/344.14 |
| 6,089,666 | A | * | 7/2000 | Rosko | 297/344.14 |
| 6,126,236 | A | * | 10/2000 | Wu | 297/325 |

FOREIGN PATENT DOCUMENTS

| | | | | |
|---|---|---|---|---|
| DE | 3304894 | * | 10/1983 | 297/16.1 |

* cited by examiner

*Primary Examiner*—Daniel P. Stodola
*Assistant Examiner*—Hugh B. Thompson
(74) *Attorney, Agent, or Firm*—Harness, Dickey & Pierce, P.L.C.

(57) ABSTRACT

A high chair includes a foldable frame having a pair of front legs and a pair of rear legs, a seat and a backrest mounted on the frame between the front legs and between the rear legs, and a pair of pivotal coupler devices, each of which is connected to one of the front legs and one of the rear legs. Each of the coupler devices includes first and second casing halves respectively having substantially circular opposite base walls which are connected pivotally to two opposite ends of a pivot shaft, and which respectively have peripheral flanges substantially extending circumferentially. The peripheral flanges extend toward and overlap one another. The peripheral flange of the first casing half includes a first slot and a second slot which is spaced from the first slot in an angular direction relative to the pivot shaft. A spring-loaded button is mounted on the base wall of the second casing half, and has a button head biased to extend radially and outwardly of a respective one of the peripheral flanges. The first and second casing halves are turnable about the pivot shaft between a first state, in which the button head projects out of the peripheral flange of the first casing half via the first slot, and a second state, in which the button head projects out of the peripheral flange of the first casing half via the second slot.

3 Claims, 4 Drawing Sheets

HIGH CHAIR HAVING LOCKABLE PIVOTAL COUPLER DEVICE

BACKGROUND OF THE INVENTION

1. Field of the Invention

The invention relates to a high chair, more particularly to a high chair having lockable pivotal coupler devices.

2. Description of the Related Art

Generally, high chairs are designed for children to facilitate feeding. For stability, a conventional high chair is designed to occupy a relatively large area when legs thereof are expended. However, when the conventional high chair is not in use, it is inconvenient to store and carry.

SUMMARY OF THE INVENTION

Therefore, the object of the present invention is to provide a high chair that occupies a relatively small amount of space when not in use, and that has legs which can be folded or extended conveniently.

According to the present invention, a high chair includes a foldable frame having a pair of front legs and a pair of rear legs, a seat and a backrest mounted on the frame between the front legs and between the rear legs, and a pair of pivotal coupler devices.

Each of the coupler devices is connected to a top end of one of the front legs and a top end of one of the rear legs so as to permit the front and rear legs to turn relative to each other for movement toward or away from each other. Each of the coupler devices includes first and second casing halves respectively formed with leg connecting sleeves, and a pivot shaft. The first and second casing halves respectively have substantially circular opposite base walls which are connected pivotally to two opposite ends of the pivot shaft, and which respectively have peripheral flanges substantially extending circumferentially. The peripheral flanges extend toward and overlap one another. The peripheral flange of the first casing half extends outwardly of the peripheral flange of the second casing half, and includes a first slot and a second slot which is spaced from the first slot in an angular direction relative to the pivot shaft. Each of the coupler devices further includes a spring-loaded button which is mounted on the base wall of the second casing half, and which has a button head biased to extend radially and outwardly of a respective one of the peripheral flanges. The first and second casing halves are turnable about the pivot shaft between a first state, in which the button head projects out of the peripheral flange of the first casing half via the first slot, and a second state, in which the button head projects out of the peripheral flange of the first casing half via the second slot.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
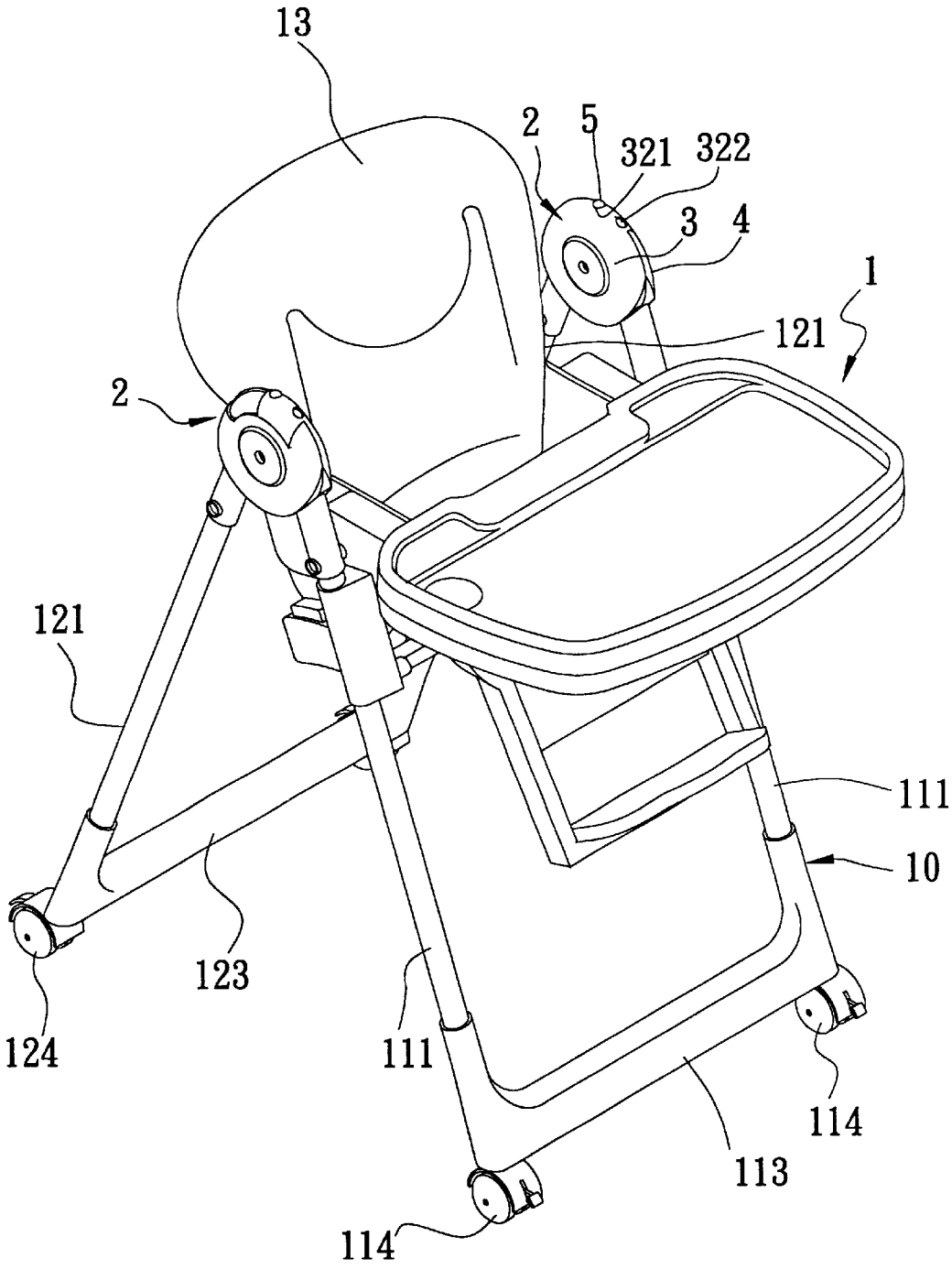
FIG. 1 is a perspective view of the preferred embodiment of a high chair according to this invention.

Referring to FIGS. 1 to 4, according to the preferred embodiment of this invention, a high chair 1 is shown to include a foldable frame 10, a seat 12, a backrest 13, and a pair of pivotal coupler devices 2.

The frame 10 has a pair of front legs 111, and a pair of rear legs 121. A U-shaped front leg seat 113 has a base portion provided with a pair of rolling wheels 114, and upwardly extending opposite sleeve portions respectively coupled to bottom ends of the front legs 111. A U-shaped rear leg seat 123 has a base portion provided with a pair of rolling wheels 124, and upwardly extending opposite sleeve portions respectively coupled to bottom ends of the rear legs 121.

The seat 12 and the backrest 13 are mounted on the frame 10 between the front legs 111 and between the rear legs 121.

Figure 2:
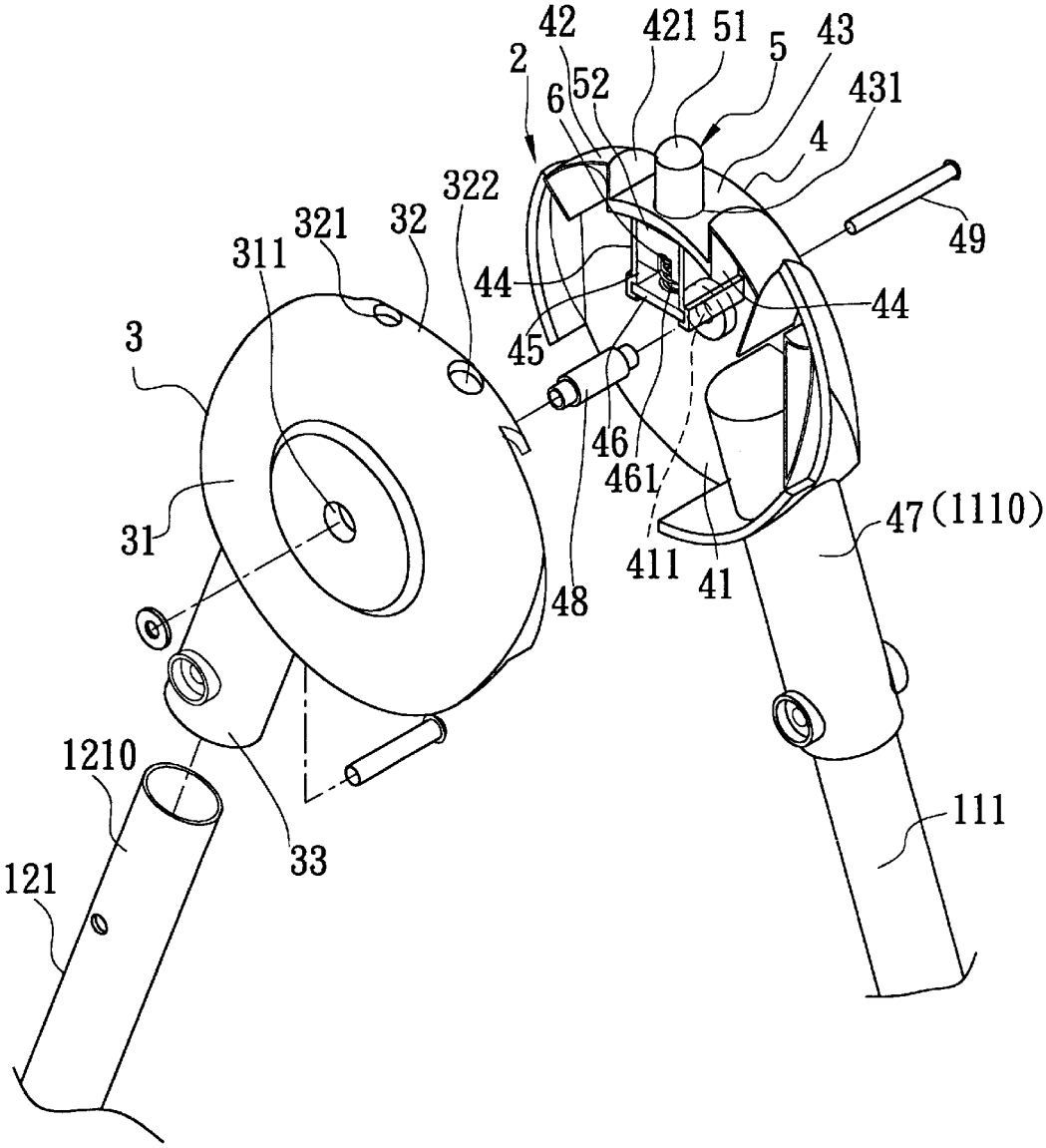
FIG. 2 is an exploded view of a pivotal coupler device of the preferred embodiment.
Figure 3:
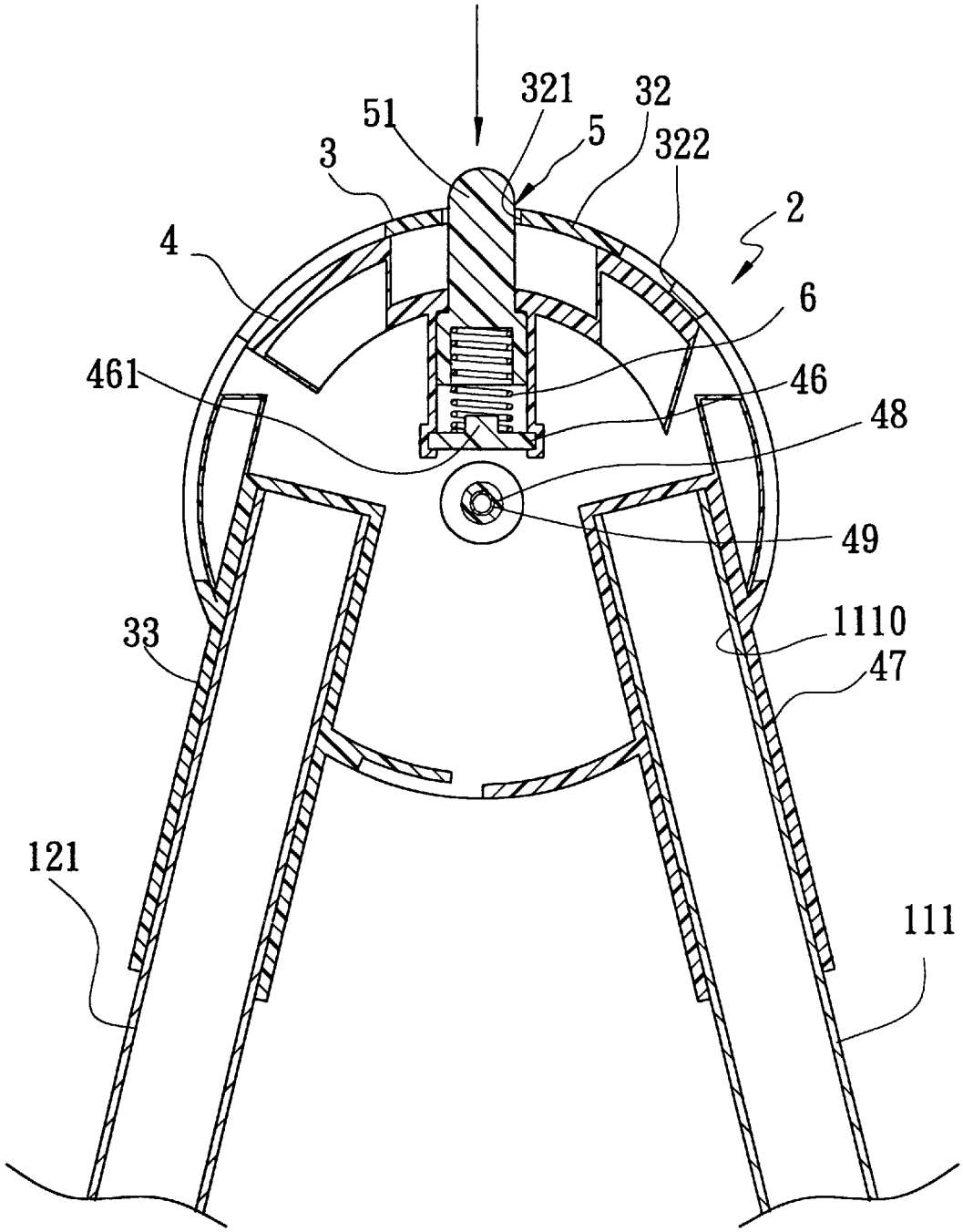
FIG. 3 is a sectional schematic of the coupler device of the preferred embodiment.

Each of the coupler devices 2 is connected to one of the front legs 111 and one of the rear legs 121 so as to permit the front and rear legs 111, 121 to turn relative to each other for movement toward or away from each other. As shown in FIGS. 2 and 3, each of the coupler devices 2 includes first and second casing halves 3, 4 respectively formed with leg connecting sleeves 33, 47 that are respectively connected to a top end 1110 of the one of the front legs 111 and a top end 1210 of the one of the rear legs 121, a pivot shaft 49, and a spring-loaded button 5.

The first and second casing halves 3, 4 respectively have substantially circular opposite base walls 31, 41 which are respectively formed with pivot holes 311, 411 connected pivotally to two opposite ends of the pivot shaft 49 via a pivot sleeve 48 sleeved on the pivot shaft 49, and which respectively have peripheral flanges 32, 42 substantially extending circumferentially. The peripheral flanges 32, 42 extend toward and overlap one another. The peripheral flange 32 of the first casing half 3 extends outwardly of the peripheral flange 42 of the second casing half 4, and includes a first slot 321 and a second slot 322 which is spaced from the first slot 321 in an angular direction relative to the pivot shaft 49.

Figure 4:
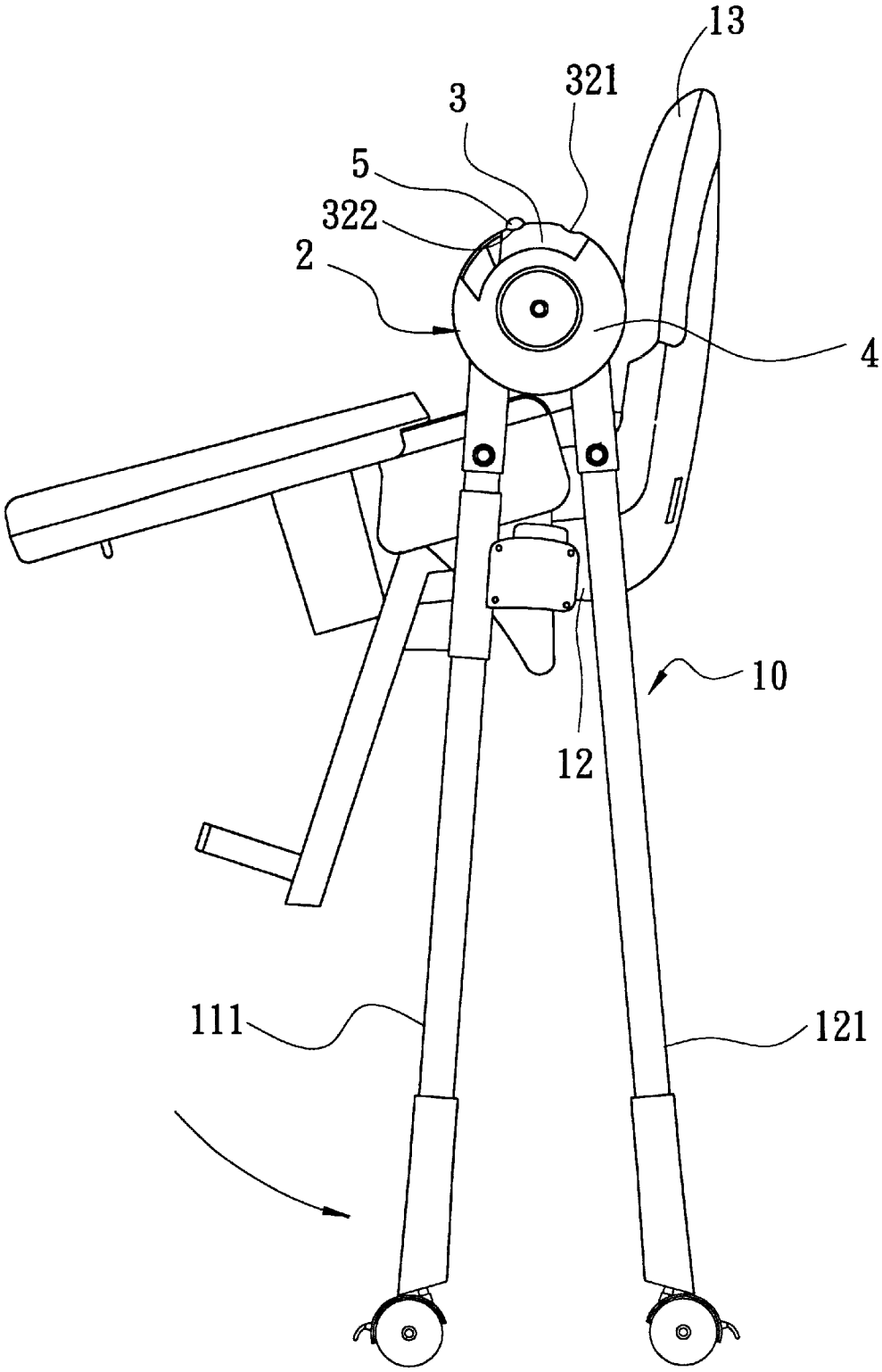
FIG. 4 is a schematic side view of the preferred embodiment illustrating the front and rear legs of the high chair in a folded state.

The button 5 is mounted on the base wall 41 of the second casing half 4, and has a button head 51 biased to extend radially and outwardly of the peripheral flange 42. The peripheral flange 42 of the second casing half 4 has an arcuate indented wall part 43 which defines an indentation 421 inwardly of the peripheral flange 32 of the first casing half 3, and which has a through hole 431 for passage of the button head 51. The indented wall part 43 is spaced from the peripheral flange 32 of the first casing half 3. The base wall 41 of the second casing half 4 has a button receiving space 45. The button receiving space 45 is confined by two opposite confining walls 44 extending inwardly from the indented wall part 43 and a transverse wall 46 opposite to the indented wall part 43 and connected to the confining walls 44. The button 5 further includes an abutting portion 52 having a size larger than that of the through hole 431 in the indented wall part 43. The abutting portion 52 is received inside the button receiving space 45, and abuts against the indented wall part 43. The button 5 is capable of being mounted inside the button receiving space 45, and incorporates a compression spring 6 which is mounted on a post 461 extending inwardly of the button receiving space 45 from the transverse wall 46, and which biases the button 5 in a radial direction. As such, the first and second casing halves 3, 4 are turnable about the pivot shaft 49 between a first state, in which the button head 51 projects out of the peripheral flange 32 of the first casing half 3 via the first slot 321 when the high chair 1 is in use, as shown in FIG. 1, and a second state, in which the button head 51 projects out of the peripheral flange 32 of the first casing half 3 via the second slot 322 when the high chair 1 is not in use, as shown in FIG. 4.

By providing additional slots between the first and second slots 321, 322 in the peripheral flange 32 of the first casing half 3, multi-stage adjustment of angle between the front legs 111 and the rear legs 121 is possible. It is noted that the high chair 1 of this invention can be easily operated between the first and second states by pressing the button head 51 and turning the front and rear legs 111, 121 toward each other. In the second state of the first and second casing halves 3, 4, the high chair 1 is folded so as to reduce the size thereof. The object of the invention is thus met. While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A high chair comprising:

a foldable frame having a pair of front legs and a pair of rear legs;

a seat and a backrest mounted on said frame between said front legs and between said rear legs; and a pair of pivotal coupler devices, each of which is connected to a top end of one of said front legs and a top end of one of said rear legs so as to permit said front and rear legs to turn relative to each other for movement toward or away from each other, each of said coupler devices including first and second casing halves respectively formed with leg connecting sleeves, and a pivot shaft, said first and second casing halves respectively having substantially circular opposite base walls which are connected pivotally to two opposite ends of said pivot shaft, and which respectively have peripheral flanges substantially extending circumferentially, said peripheral flanges extending toward and overlapping one another, said peripheral flange of said first casing half extending outwardly of said peripheral flange of said second casing half and including a first slot and a second slot which is spaced from said first slot in an angular direction relative to said pivot shaft, each of said coupler devices further including a spring-loaded button which is mounted on said base wall of said second casing half and which has a button head biased to extend radially and outwardly of a respective one of said peripheral flanges, said first and second casing halves being turnable about said pivot shaft between a first state, in which said button head projects out of said peripheral flange of said first casing half via said first slot, and a second state, in which said button head projects out of said peripheral flange of said first casing half via said second slot.

2. The high chair of claim 1, wherein said peripheral flange of said second casing half has an arcuate indented wall part which defines an indentation inwardly of said peripheral flange of said first casing half and which has a through hole for passage of said button head, said indented wall part being spaced from said peripheral flange of said first casing half.

3. The high chair of claim 2, wherein said base wall of said second casing half has a button receiving space, said button receiving space being confined by two opposite confining walls extending inwardly from said indented wall part and a transverse wall opposite to said indented wall part and connected to said confining walls, said button being mounted inside said button receiving space and incorporating a compression spring which biases said button in a radial direction.

* * * * *